US008402889B2

(12) United States Patent
Caron

(10) Patent No.: US 8,402,889 B2
(45) Date of Patent: Mar. 26, 2013

(54) APERTURED MEDIA EMBELLISHING TEMPLATE AND SYSTEM AND METHOD USING SAME

(75) Inventor: James Jeffrey Caron, Peoria, AZ (US)

(73) Assignee: Spellbinders Paper Arts Company, LLC, Peoria, AZ (US)

( * ) Notice: Subject to any disclaimer, the term of this patent is extended or adjusted under 35 U.S.C. 154(b) by 455 days.

(21) Appl. No.: 12/341,146

(22) Filed: Dec. 22, 2008

(65) Prior Publication Data

US 2009/0104570 A1 Apr. 23, 2009

Related U.S. Application Data

(60) Division of application No. 11/049,443, filed on Feb. 2, 2005, now Pat. No. 7,469,634, which is a continuation-in-part of application No. 10/814,003, filed on Mar. 31, 2004, now abandoned.

(60) Provisional application No. 60/627,701, filed on Nov. 12, 2004, provisional application No. 60/541,478, filed on Feb. 3, 2004.

(51) Int. Cl.
*B31F 1/07* (2006.01)
*B41F 19/02* (2006.01)
*B44B 5/00* (2006.01)

(52) U.S. Cl. ..... 101/26; 101/30; 101/32

(58) Field of Classification Search ..... 101/30; 216/11, 41; 430/323
See application file for complete search history.

(56) References Cited

U.S. PATENT DOCUMENTS 332,300 A 12/1885 Stollstorff
753,740 A * 8/1901 Rockstroh ..... 101/30
1,453,405 A 5/1923 Platt
1,658,823 A 2/1928 Willard
2,005,340 A 6/1935 Jaffin et al.
2,056,321 A 10/1936 Haumont
2,112,011 A 3/1938 Byerlein
3,094,091 A 6/1963 Peccerill
3,584,522 A 6/1971 Smafield
3,584,572 A 6/1971 Apicella
3,643,303 A 2/1972 Kanarek
3,754,327 A * 8/1973 Lisa ..... 30/316
3,850,059 A 11/1974 Kang
3,935,811 A 2/1976 Lenz et al.
3,936,384 A 2/1976 Williams
3,946,195 A 3/1976 Lyons et al.
4,155,801 A 5/1979 Provancher
(Continued)

FOREIGN PATENT DOCUMENTS

DE 614618 6/1935
GB 164 247 6/1921
(Continued)

OTHER PUBLICATIONS

Embossing Arts Co., catalog, Sep. 1, 1997, advertising brass stencil.

*Primary Examiner* — Judy Nguyen
*Assistant Examiner* — Marissa Ferguson Samreth
(74) *Attorney, Agent, or Firm* — Fay Sharpe LLP

(57) ABSTRACT

A multi-function media embellishing template and a system and method of embellishing media with the template is provided. The template includes a body having a media abutment surface and an aperture in the media abutment surface extending through the template, and an embellishing wall extending from the media abutment surface and terminating in an embellishing surface. The media embellishing template can be formed by exposing first and second sides of a template blank not covered by a resist to etchant, etching the surface of the first side to form a media abutment surface and an embellishing wall extending from the media abutment surface and terminating in an embellishing surface, and etching the surface of the second side not covered by the resist to form at least one aperture extending through the template.

10 Claims, 8 Drawing Sheets

U.S. PATENT DOCUMENTS

| | | | | | |
|---|---|---|---|---|---|
| 4,204,468 | A | | 5/1980 | Harrison | |
| 4,215,194 | A | * | 7/1980 | Shepherd | 430/323 |
| D257,777 | S | | 1/1981 | Eichenberg et al. | |
| 4,257,251 | A | | 3/1981 | Jury | |
| 4,278,017 | A | | 7/1981 | Conjura | |
| 4,328,067 | A | | 5/1982 | Cesano | |
| 4,361,085 | A | | 11/1982 | Schutz | |
| 4,386,123 | A | | 5/1983 | Coburn, Jr. | |
| 4,503,110 | A | | 3/1985 | Skene | |
| 4,574,693 | A | | 3/1986 | Fink et al. | |
| 4,711,800 | A | * | 12/1987 | DiVincenzo | 428/131 |
| D296,565 | S | | 7/1988 | Eichenberg et al. | |
| 4,781,205 | A | | 11/1988 | Shakley | |
| 4,867,057 | A | | 9/1989 | Bradley et al. | |
| 4,928,588 | A | | 5/1990 | Mathis | |
| 4,960,659 | A | * | 10/1990 | Sagou | 430/23 |
| 5,046,415 | A | | 9/1991 | Oates | |
| 5,057,401 | A | * | 10/1991 | Borysko et al. | 430/320 |
| 5,255,587 | A | | 10/1993 | Eichenberg et al. | |
| D341,842 | S | | 11/1993 | Eichenberg et al. | |
| 5,290,384 | A | | 3/1994 | Ketelhohn et al. | |
| D359,967 | S | | 7/1995 | Eichenberg et al. | |
| 5,488,889 | A | | 2/1996 | Kang | |
| 5,571,280 | A | | 11/1996 | Lehrer | |
| 5,628,226 | A | | 5/1997 | Weissman | |
| 5,660,105 | A | | 8/1997 | Benson et al. | |
| 5,693,454 | A | * | 12/1997 | Munoz | 430/320 |
| 5,722,319 | A | | 3/1998 | Hirano | |
| 5,733,465 | A | | 3/1998 | Kitamura et al. | |
| 5,762,811 | A | * | 6/1998 | Munoz | 216/11 |
| 5,775,213 | A | | 7/1998 | Hyde | |
| 5,782,156 | A | | 7/1998 | Collins | |
| 5,900,160 | A | | 5/1999 | Whitesides et al. | |
| 6,007,754 | A | | 12/1999 | Crawford et al. | |
| 6,032,565 | A | | 3/2000 | Okonski et al. | |
| 6,076,444 | A | | 6/2000 | Okonski | |
| 6,186,936 | B1 | | 2/2001 | Smith et al. | |
| 6,223,641 | B1 | | 5/2001 | Kang | |
| 6,444,075 | B1 | | 9/2002 | Schneider et al. | |
| 6,582,615 | B2 | | 6/2003 | Hutchison et al. | |
| 6,619,195 | B2 | | 9/2003 | Corcoran et al. | |
| 6,626,965 | B2 | | 9/2003 | Workman et al. | |
| 6,715,394 | B2 | | 4/2004 | O'Dell et al. | |
| 6,766,733 | B1 | | 7/2004 | Collins | |
| 6,994,024 | B2 | | 2/2006 | Corcoran et al. | |
| 7,055,427 | B2 | | 6/2006 | Caron | |
| 2001/0000860 | A1 | | 5/2001 | Smith et al. | |
| 2002/0178935 | A1 | | 12/2002 | Corcoran et al. | |
| 2003/0019370 | A1 | | 1/2003 | Corcoran et al. | |
| 2004/0112196 | A1 | | 6/2004 | Corcoran et al. | |
| 2004/0118304 | A1 | | 6/2004 | Corcoran et al. | |
| 2005/0126407 | A1 | | 6/2005 | Hixon et al. | |

FOREIGN PATENT DOCUMENTS

| | | |
|---|---|---|
| JP | 410199360 | 7/1998 |
| JP | 2003-272998 | 9/2003 |
| WO | WO 01 17794 | 3/2001 |
| WO | WO 03/016035 | 2/2003 |

* cited by examiner

APERTURED MEDIA EMBELLISHING TEMPLATE AND SYSTEM AND METHOD USING SAME

CROSS REFERENCE TO RELATED APPLICATIONS

This application is a divisional of U.S. application Ser. No. 11/049,443 filed on Feb. 2, 2005 now U.S. Pat. No. 7,469,634 which claims the benefit of U.S. Provisional Application No. 60/627,701, filed Nov. 12, 2004 and also claims the benefit of U.S. Provisional Application No. 60/541,478 filed Feb. 3, 2004, and is a continuation-in-part of prior application Ser. No. 10/814,003, filed Mar. 31, 2004 now abandoned, all of which are hereby incorporated by reference herein in their entirety.

BACKGROUND

The present invention relates to a system and method of embellishing media, and more particularly to a media embellishing template.

The papercraft and scrapbook industry has become widely popular seeing explosive growth in recent years. Many people have taken up the hobby of keeping mementos and photos in scrapbooks and they wish to personalize their collections using embellished media, such as template cut and/or embossed paper and the like.

Typical known systems for embellishing media use a press for pressing the media against a template to embellish the media. These systems use a template having an embellishing surface for embellishing the media during pressing. The embellishing surface may be a die cut blade for die cutting the media. The embellishing surface may be a recess or protrusion for embossing the media. It is desirable to provide a template for embellishing media in a variety of different ways.

SUMMARY OF THE INVENTION

According to the present invention, a new and improved multi-function embellishing template for embellishing media is provided.

In accordance with a first aspect of the invention, the embellishing template includes a body having a media abutment surface and an aperture in the media abutment surface extending through the body, and an embellishing wall extending from the media abutment surface and terminating in an embellishing surface.

In accordance with another aspect of the invention, a method of forming a media embellishing template from a template blank having body with a first side and a second side disposed opposite the first side is provided. The method includes placing resist on a first side of a template blank, placing resist on a second side of the template blank, exposing the first side to etchant, exposing the second side to etchant, etching the surface of the first side not covered by the resist to form a media abutment surface and an embellishing wall extending from the media abutment surface, the embellishing wall terminating in an embellishing surface, and etching the surface of the second side not covered by the resist to form at least one aperture extending through the template.

In accordance with another aspect of the invention, a method of embellishing media with a press is provided. The method includes placing sheet media against an embellishing template first surface, the first surface having an embellishing wall extending therefrom and terminating in an embellishing surface and an aperture formed therein and extending through the embellishing template, pressing the media against the embellishing template first surface, pressing the media into the aperture forming a protruding embellishment in the media, pressing the media against the embellishing surface forming a second embellishment in the media.

The advantages and benefits of the present invention will become apparent to those of ordinary skill in the art upon reading and understanding the following detailed description of the preferred embodiments.

BRIEF DESCRIPTION OF THE DRAWINGS

The invention may take form in certain components and structures, preferred embodiments of which will be illustrated in the accompanying drawings wherein.

DETAILED DESCRIPTION OF THE INVENTION

It is to be understood that the specific devices and processes illustrated in the attached drawings, and described in the following specification are simply exemplary embodiments of the inventive concepts defined in the appended claims. Hence, specific examples and characteristics relating to the embodiments disclosed herein are not to be considered as limiting, unless the claims expressly state otherwise.

The term "embellish" as used herein refers to altering the appearance of media. Media can be embellished by cutting, such as for example by die cutting with a template, and/or by embossing and/or by stenciling. The term "embossing" as used hereinafter refers to forming a three dimensional impression of a template in the media. The embossing is dry embossing which does not use heat. The media can be sheet material suitable for embellishing including, but not limited to, paper, card stock, cardboard, metal, such as for example metal foil or other thin metals, and plastic, among others.

Figure 1:
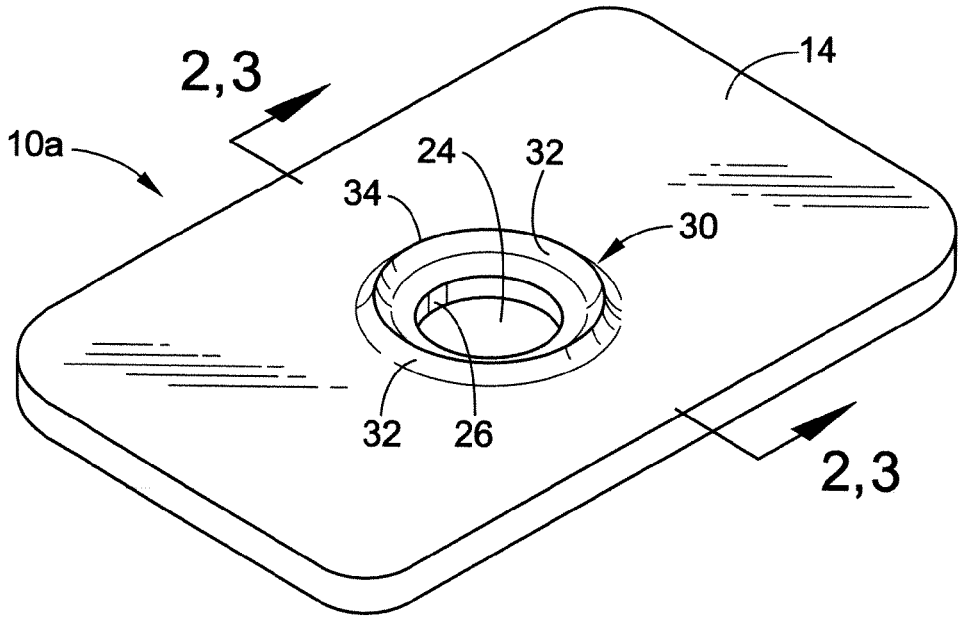
FIG. 1 is a perspective view illustrating an embellishing template in accordance with the invention.
Figure 2:
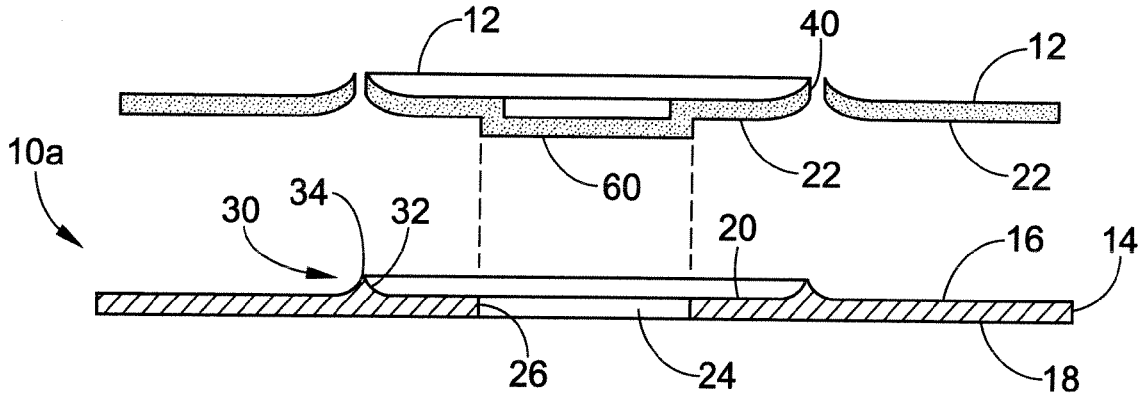
FIG. 2 illustrates a sectional elevational view of the embellishing template shown in FIG. 1 and embellished media which is die cut in accordance with the invention.
Figure 3:
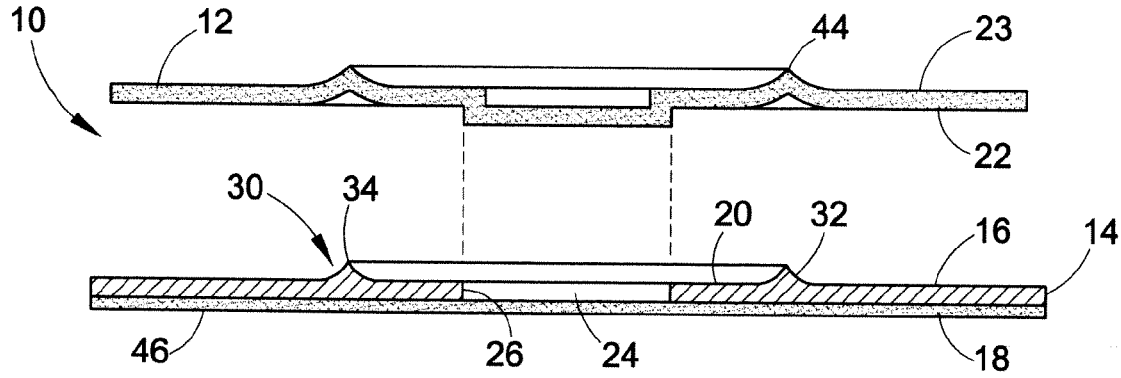
FIG. 3 illustrates a sectional elevational view of the embellishing template shown in FIG. 1 and media embellished in accordance with the invention.

Referring to FIGS. 1-3, a media embellishing template is shown generally at 10*a* for embellishing media 12, which in the illustrated embodiment is sheet media. The template 10*a* includes a body 14 having a first side 16, and a second side 18 disposed opposite the first side. The body 14 is generally hard and can be formed of metal, including but not limited to steel, such as hard steel, spring steel, 1065-1075 steel, or other materials hard enough to retain, in operating condition, one or more embellishing surfaces formed thereon after multiple pressings. The template 10*a* can be formed of an etchable material, such as a chemically etchable material, as is explained in further detail below. The body 14 can be generally flat, apart from protrusions extending therefrom or recesses formed therein as described below. The body 14 can be about 0.010 inches to about 0.060 inches thick, though other thicknesses suitable for pressing may be used. In one example, which should not be considered limiting, the body 14 is about 0.032 inches to about 0.036 inches thick.

The template body 14 includes a first surface 20 disposed on the first side 16 for abutting or contacting a first side 22 of the media 12 during pressing. The first surface 20 includes one or more apertures 24, which can also be referred to a through holes or windows, extending through the template body 14. Each aperture 24 includes an aperture wall 26 extending through the template body 14, from the first side 16 to the second side 18.

The templates 10*a*, 10*b* shown in FIGS. 1-4 include a single aperture 24 having a circular shape formed in the first surface 20, however, it should be appreciated this template is simplified for the purposes of illustration and that the template 10 can include any suitable number of apertures 24 extending through the template body 14. The one or more apertures 24 can have similar shapes, or different shapes, which define an embossing pattern for forming an embossed impression, also referred to as an embellishment, in the media 12 during pressing as shall be described in further detail below.

The template body 14 also includes an embellishing wall 30 having raised wall surface 32 extending from the first surface 20 and terminating in an embellishing surface 34. The embellishing surface 34 can be an edge, sharp enough to cut through the media 12 to create a cut edge 40 on the media 12 by generating a sufficient force against the embellishing surface 34 during pressing. In this example, the embellishing wall 30 can be referred to as a blade, a die cut blade, or a ribbon die blade, and the embellishing surface 34 can be referred to as a blade edge. However, the amount of force applied to the media 12 and template 10*a* by the press during pressing can be varied, as described below. Accordingly, lower forces may be generated during pressing so that the blade 30 only creates a protrusion 44 in the media 12 forming a protruding embellishment 44 extending from the second side of the media 23 as shown in FIG. 3, instead of a cut edge 40. In this manner, the template 10*a* with blade 30 can be used for embossing the media 12 rather than for cutting it. It should be appreciated that, for a particular media 12 of a particular thickness, an inverse relationship exists between the sharpness of the embellishing surface 34 and the amount of force needed for cutting it, such that a sharper edge requires lower press forces.

Figure 4:
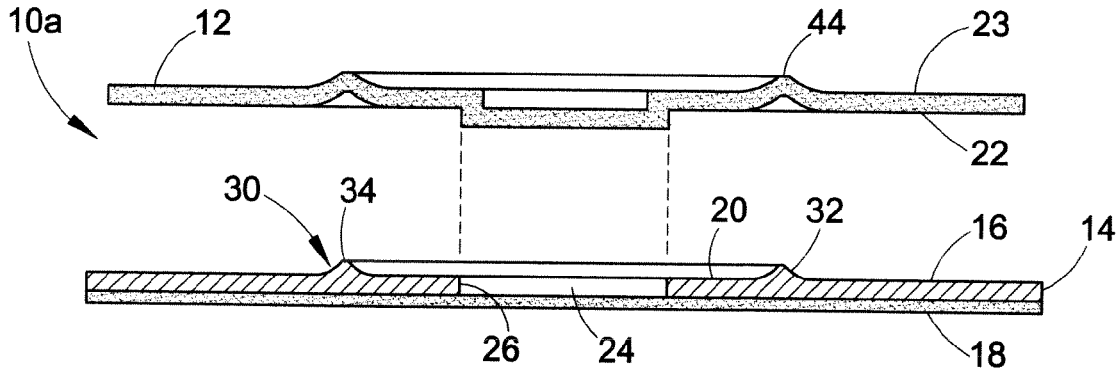
FIG. 4 illustrates a sectional elevational view of an alternate embodiment of the embellishing template shown in FIG. 1 and embellished media formed in accordance with the invention.

In other embodiments, such as the template shown generally at 10*b* in FIG. 4, the embellishing wall 30, or portions of it, can include an embellishing surface 34 that is formed to be less sharp than the blade edge referred to above. The embellishing wall 30, the wall surface 32 and the embellishing surface 34, in these embodiments can be referred to collectively as embossing surfaces used primarily for embossing the media 12, rather than for cutting it. However, with the application of exceedingly high press forces, even a flatter embellishing surface 34 intended primarily for embossing can push through the media 12 thereby cutting it. Therefore, it should be appreciated the press forces applied during pressing should have a magnitude falling within a range which depends at least on the type and thickness of the media, the dimensional characteristics of the embellishing surface 34 and the type of embellishment desired.

The embellishing wall 30 shown in FIGS. 1-4, extends along the first surface 20 to form a pattern, such as the circular pattern shown. However, it should be appreciated this pattern has been simplified for the purposes of example, and that the wall 30 can traverse the first surface 20 in any suitable pattern for forming a corresponding cut edge 40 or protrusion 44 in the media 12. The embellishing wall 30 can extend along the first surface 20 in a continuous manner forming a single embellishing wall.

Figure 5:
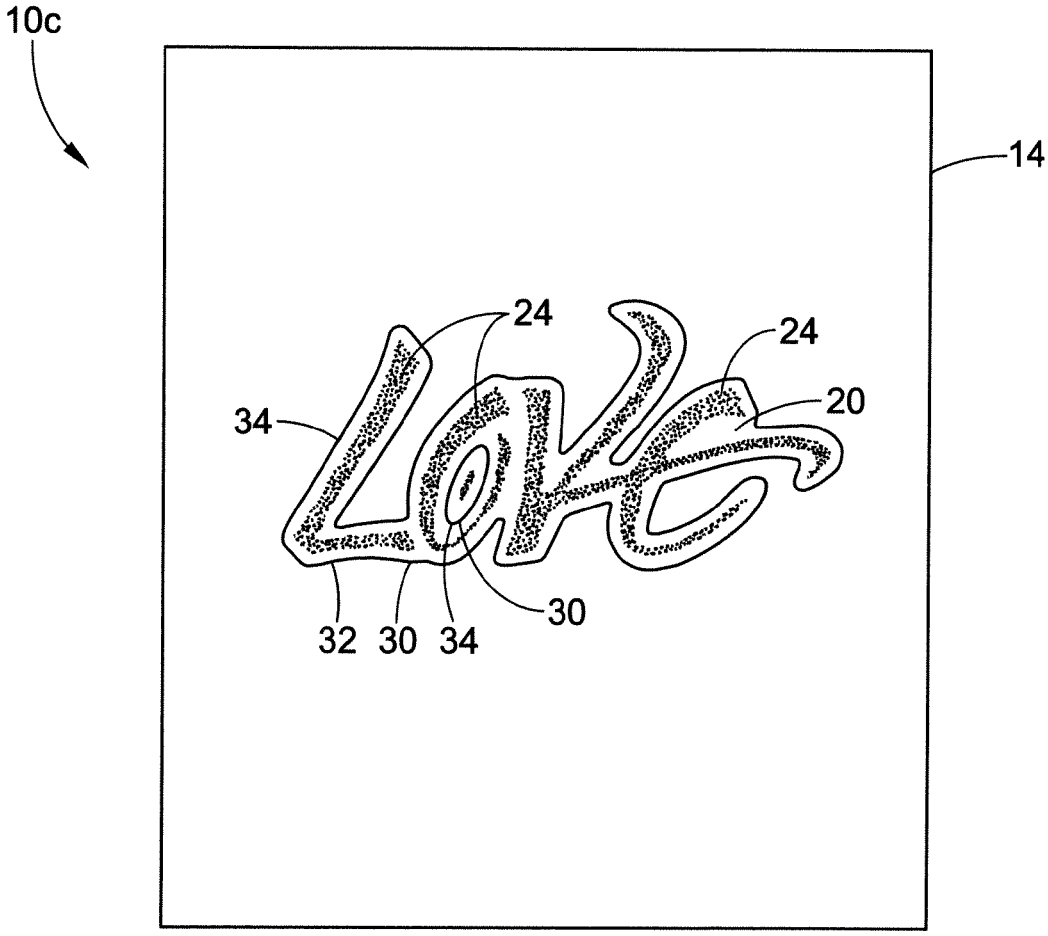
FIG. 5 is a top view illustrating an alternate embodiment of the embellishing template in accordance with the invention.

In an alternate embodiment of the template, shown generally at 10*c* in FIG. 5, the body 14 includes a plurality of spaced apart embellishing walls 30 having raised wall surfaces 32 extending from the first surface 20 and terminating in embellishing surfaces 34. The body 14 also includes a plurality of apertures, shown as shaded portions 24, disposed in the first surface 20 and extending through the body. The embellishing walls 30 and apertures 24 form the word "LOVE". The template 10*c* can be used to die cut media in the form of the word "LOVE". The template 10*c* can also be used to emboss the word "LOVE" in the media 12 by applying press forces having a lower magnitude as described below. The template 10*c* can also emboss and die cut the word "LOVE" in a media 12.

The embellishing wall 30 can circumscribe the one or more apertures 24. For example, as shown in FIGS. 1 and 2, the embellishing wall 30, or portions of it, can have an embellishing surface 34 formed as a blade edge circumscribing the one or more apertures 24 so as to form a die cut blade for creating a die cut embellishment. The die cut blade 30 cuts a die cut embellishment from the media 12 having a cut edge 40. The cut edge 40 extends around the entire periphery of the embellishment in a shape corresponding to the shape the embellishing wall forms as it traverses across the first surface 20. The die cut embellishment formed by this template 10*b* will also include one or more protruding embellishments 60 having shapes corresponding to the one or more apertures 24. In this manner, a variety of different templates 10 can be used to form a vast array of different shaped die cut embellishments, each having protruding patterns embossed in them.

The template body 14 is preferably a unitary or one-piece unit formed of the template material described above. However, as shown in the alternate embodiment of FIG. 3, the template 10*b* can include an optional backing 46 disposed on the second side 18 of the body 14. The backing 46 can be formed of a pliable foam material, a sponge rubber material, or a closed cell polyethylene, among others, applied to the second side 18 with an adhesive or other securing means. The aperture 24 can extend only through the body 14 or it can extend through both the body and the backing.

Figure 6:
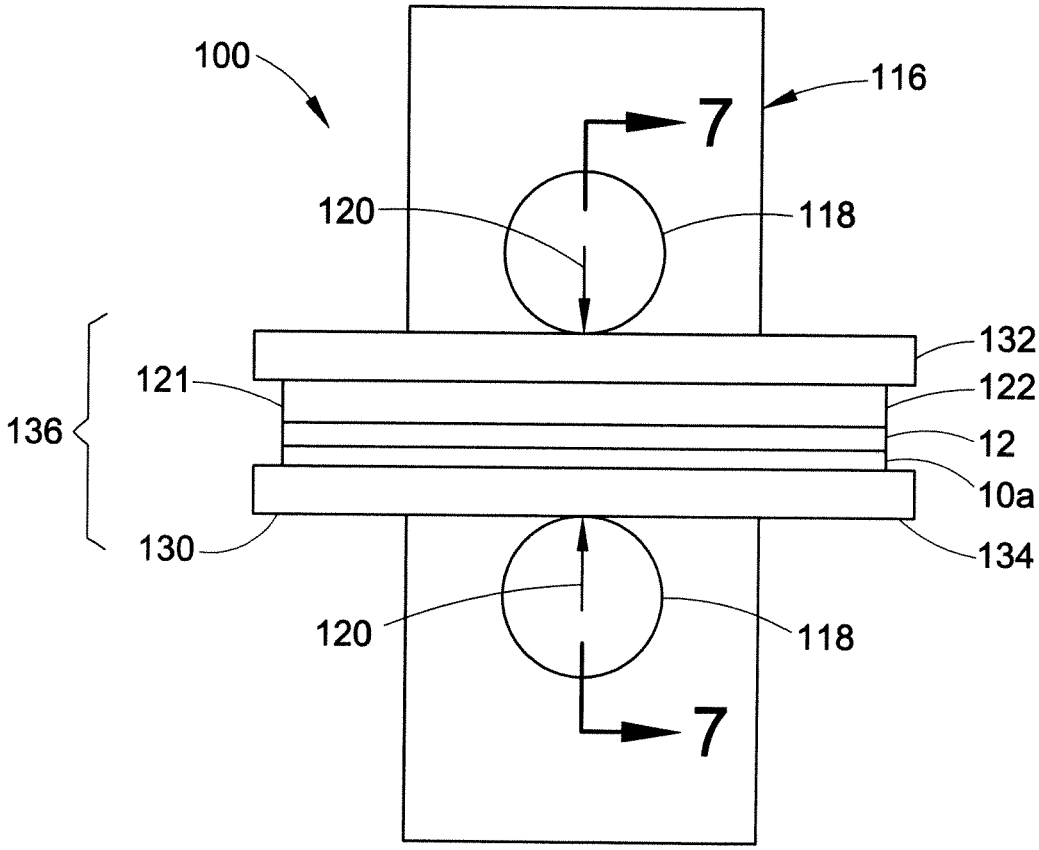
FIG. 6 is a block diagram illustrating a system for embellishing media using a rigid spacer as a spacer.
Figure 7:
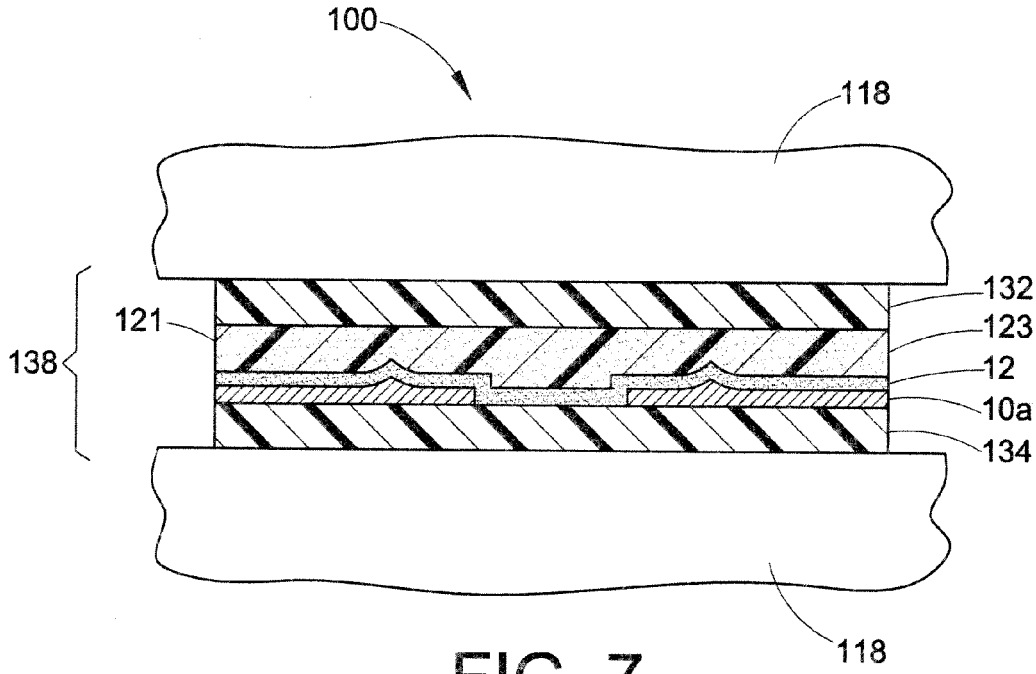
FIG. 7 is a sectional elevational view of the system for embellishing media shown in FIG. 6 using an elastomeric pad as a spacer.

Referring to FIGS. 6 and 7, a system for embellishing media 16 is shown generally at 100. The system 100 includes at least one of the embellishing templates 10, 10*a* as described above is used herein by way of example, and a press 116 having press members 118 for applying press forces, shown by arrows 120, during pressing. The press 116 can be a roller press having rollers for press members 118, or another press suitable for pressing the media 12 against the embellishing template 10*a* to embellish the media. During pressing, while applying press forces 120, the press members 118 can be maintained a fixed distance apart from each other. For example, the roller press rollers 118 are spaced apart by a fixed distance and supported for rotation at each end by bearings which do not allow the rollers to move away from each other during pressing. As an example, which should not be considered limiting, the outer surfaces of the press rollers 118 can be disposed about 0.700 inches to about 0.750 inches apart.

The system 100 can further include a rigid platen plate assembly 130 for transferring press forces 120 from the press members 118 to the media 12 and template 10*a* for pressing the media and template together during pressing. The platen plate assembly can also distribute the press forces 120 when press members 118 that are not generally planar, such as roller press members, are used in the press 116. The platen plate assembly 130 can include a first flat portion 132, also referred to as a "Cut Matt", and a spaced apart second flat portion 134, also referred to as an "Emboss Matt" for pressing the media 12 and template 10*a* therebetween. The platen plate assembly 130 is formed of a rigid material, an example of which can include high density polyethylene, or polystyrene, among others. The first and second flat portions 132, 134 can be joined together, for example by a hinge, or they can be separate pieces. In the example provided herein, the platen plate first and second portions 132, 134 are about 0.335 inches thick, though other thicknesses can be used.

The system 100 can further include a spacer 121 disposed between the press members 118 for transferring press forces 120 from the press members to the media 12 and template 10*a*. The spacer 121 can abut the template 10*a* or the media 12. Different spacers 121 having different physical properties can be used to vary the press force characteristics applied to the media 12 and template 10 during pressing by press members 118 which are disposed apart by fixed distance, or reach a fixed distance apart, during pressing.

The spacer 121 can be formed having a wide range of hardnesses to accomplish different functions during pressing as described below. Further, different spacers 121, each having a different thickness can be used to vary the magnitude of the press forces 120 applied to the media 12 and template 10 by press members 118 which are disposed a fixed distance apart, or reach a fixed distance apart, during pressing.

In one example, the spacer 121 can be a rigid spacer 122 formed of a rigid material, examples which should not be considered limiting, include high density polyethylene and polystyrene. The rigid spacer 122 can be slightly pliable or resilient to be capable of regularly coming into contact with the embellishing surface 34 without prematurely dulling it. The rigid spacer 122 can have a hardness ranging from about D60 Shore to a Rockwell C hardness of about 60. In the example provided herein, the rigid spacer 122 can have a thickness of about 0.062 inches, though other thicknesses can be used in accordance with the dimensions of the press member 118 spacing and platen plate thicknesses and the thicknesses of the media 12 and template 10.

The rigid spacer 122 can be placed between a platen plate 130 (or press member 118) and the template 10*a* or media 12 for die cutting the media with the embellishing surface 34 during pressing. For example, a first pressing operation can be performing by forming a stack, also referred to as a "sandwich" 136, which is pressed between the press members 118. The sandwich 136 is formed by placing the rigid spacer 121 on top of the platen plate second flat portion 134 and then placing the template 10*c* on top of the spacer. Next the media 12 is placed on top of the template 10*a*, and the platen plate first flat portion 132 is then placed on top of the media. Alternatively, sandwich 136 can be formed with the spacer 121 placed on top of the media as shown in FIG. 6. In the example provided herein, the media can be about 0.003 inches to about 0.013 inches thick, though other thicknesses can be used. The sandwich 136 is then held approximately level and pushed between the rollers 118 as they are turned. The turning rollers 118 grasp the sandwich 136 and pull it between them as press forces 120 are applied pressing the media 12 against the template 10*a*.

Figure 8:
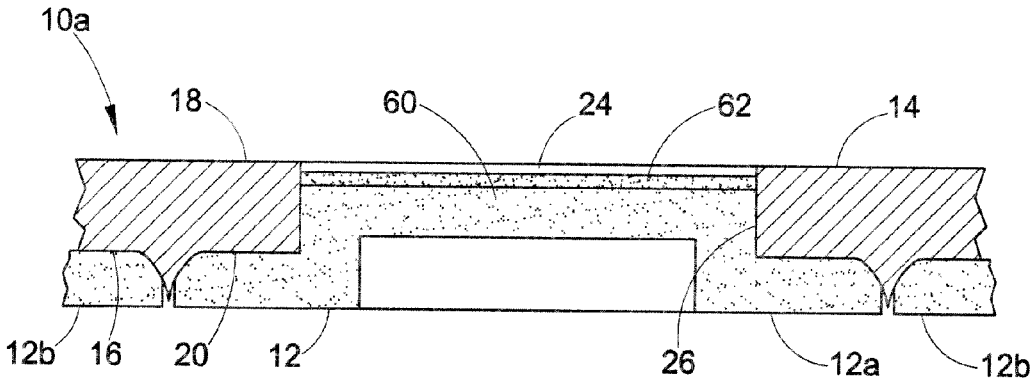
FIG. 8 is a sectional elevational view of a portion of an embellishing template and embellished media illustrating the template being used as a stencil.

After pressing in the first press operation, the die cut media will be nested within the embellishing wall 30 as shown in FIG. 8. The media 12*b* surrounding the media forming the die cut embellishment 12*a* can then be lifted away keeping the media 12*a* forming the die cut shape nested within the embellishing wall 30 for further embellishing with the template 10 if so desired, as described below.

The spacer 121 can also be an elastomeric embossing pad 123 formed of a resilient or elastic material which deforms when the press forces 120 are applied during pressing and returns to its original shape when the press forces are removed. In the example provided herein, the embossing pad 123 can have a thickness of about 0.062 inches, though other thicknesses can be used in accordance with the dimensions of the press member 118 spacing, platen plate thicknesses, and the thicknesses of the media 12 and template 10.

The die cut media 12*a* can be embossed in a second press operation. A second sandwich 138 is formed by placing the template 10*a* on the platen plate second flat portion 134 and then placing the die cut media 12 on top of the template, nested within the embellishing wall 30. Next, an elastomeric embossing pad 123 is placed on top of the media 12 and the platen plate first flat portion 132 is placed on top of the embossing pad. The second sandwich 138 is then fed between the rollers 118 as they are turned for pressing the second press operation. The template 10*a* is pressed together with the die cut media 12*a* between the press members 118 which apply press forces 120 of sufficient magnitude to press the media against the first surface 20 of the template body 14 and into the aperture(s) 24 extending through the template body 14 to form one or more corresponding protruded embellishments in the media (see 60 in FIG. 2). The protruded embellishment(s) 60 has the same shape as that of the corresponding aperture(s) 24 formed in the template first surface 20.

In another example, the elastomeric pad 123 is used to embellish the media with the template 10 in a single press operation. The press forces 120 press the media 12 into the aperture(s) 24 for embossing the media and press the media against the one or more embellishing surface 34 for embossing and/or die cutting the media. By using different embellishing walls 30 having different embellishing surfaces 34, the media 12 can be die cut and embossed by the embellishing walls in one press operation.

As described above, achieving what can considered to be a suitable embellishment in the media 12 can require different press force characteristics depending on such things as the type of media material (heavier, thicker material requires greater press forces, whereas lighter materials such as thin foils require less press forces), the amount of detail to be transferred from the template to the media (templates having smaller apertures 24 for creating finer detailed embellishments can require greater press forces), and the type of embellishment sought (such as die cutting or embossing). Examples of these press force characteristics which can be adjusted can include, but are not limited to, the magnitude of the press forces 120 generated against the media 12 and embellishing template 10, the magnitude of the pressure applied to the media 12 and embellishing template 10 from the press forces, and the spread of the press forces over the media and embellishing template.

One way of creating different press force characteristics can include using different elastomeric embossing pads 123 having different preselected hardnesses when pressing the media and the embellishing template 10 in the press 116. The press force 120 can be adjusted by using an elastomeric pad having a higher hardness for generating greater press forces and a lower hardness for generating lower press forces. It has been found that elastomeric pads having a hardness on the Shore hardness scale ranging from about A20 to about A80, and more preferably ranging from about A40 to about A65, can be used. Further, the elastomeric pad 123 can be omitted during pressing to generate greater press forces 120.

Referring again to FIG. 8, the template 10 can also be used as a stencil for embellishing the media 12, also referred to a stenciling. Material 62, including but not limited to chalk, ink, paint, glue, and glitter, among others, can be applied through the aperture 24 to the media as it lays against the template 10, and perhaps even nested within the embellishing wall 30. In one example, which should not be considered limiting, the material 62 is applied through the aperture 24 to the protruding embellishment 60 extending into the aperture after pressing. This can be done after a single press operation, or two or more press operations, are performed with the same template 10. The template first side 16 or second side 18 together with the aperture 24 and aperture wall 26 act as a stencil confining the application of the material 62 to the media in the shape defined by the aperture. Therefore, one template 10, as described herein, can be used to embellish the media 12 in three different ways including die cutting, embossing and stenciling.

Figure 9:
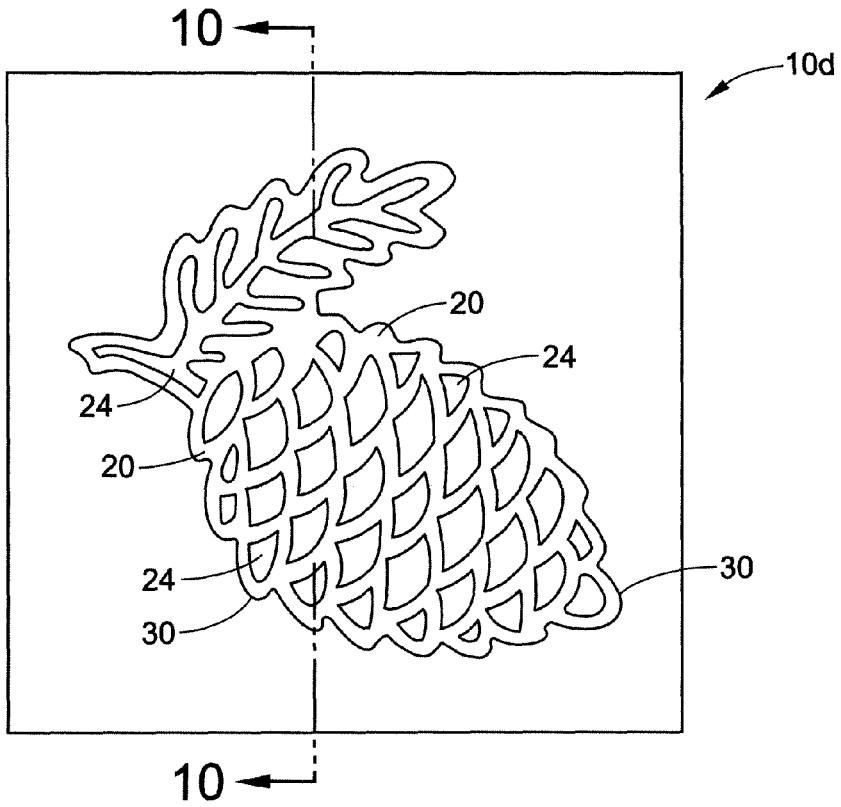
FIG. 9 is a top view of an alternate embodiment of the embellishing template in accordance with the invention.
Figure 10:
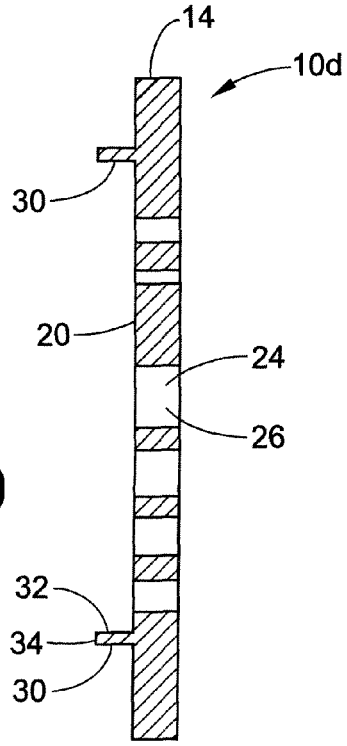
FIG. 10 is a sectional elevational view of the embellishing template shown in FIG. 9.

Referring to FIGS. 9 and 10, another embodiment of the embellishing template is shown generally at 10*d*. The template 10*d* has a template body 14 which includes a media abutting first surface 20 and an embellishing wall 30 extending from the first surface having a wall surface 32 and terminating in an embellishing surface 34. The template 10*d* also includes a plurality of apertures 24 formed in the first surface 20 having aperture walls 24 extending through template body 14. The embellishing wall 30 and apertures 24 are configured to form an embossed and die cut embellishment in the media 12 in the form of a pine cone when the template 10*d* is pressed against the media.

Figure 11:
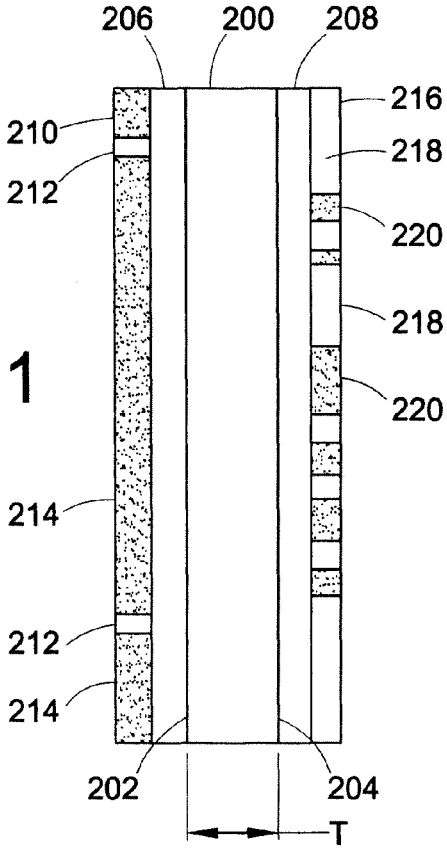
FIG. 11 is a sectional elevational view of an template blank and resist for forming the embellishing template in accordance with the invention.

The template 10*d* can be made by forming an embellishing wall 30 extending from a first template body surface 20 and terminating in an embellishing surface 34 and forming an aperture 24 in the first template body surface extending through the template body 14. Referring now to FIG. 11, the template 10*d* can be formed by chemically etching the surfaces of a template blank 200. The template blank 200 is formed of the same material as the template described above. In this example, the template blank 200 is formed of a hard, chemically etchable material, and more particularly, a 1075 specialty strip steel having a Rockwell hardness of about 44 to about 48. The template blank 200 has a first side 202 and second side 204 disposed opposite the first side and has a length and width approximately equal to that of the finished template 10*d*. The template blank 200 has a thickness T which is thicker than the finished template 10*d*.

A resist is then applied to the surfaces of the template blank 200. The resist prevents the portions of the template blank 200 disposed beneath it from being removed by the etching substance during etching. A layer of resist 206 is placed on the first side 202, and a layer of resist 208 is place on the second side 204. The resist 206, 208 can be a photo sensitive polymer film, such as Riston® by Dupont, or other suitable resists. In one example, which shouldn't be considered limiting, the resist includes two thin pieces joined along an edge and the template blank 200 is slipped between them. The template blank 200 and resist is then passed through heated rollers which laminates or melts the resist onto the template blank surfaces 202 and 204 to form the resist layers 206 and 208.

A first mask, shown generally at 210 in FIG. 11, is then applied over the resist 206 on the first side 202. The first mask 210 has light admitting portions 212 and light blocking portions 214. The light admitting portions 212 are disposed on top of the sections of the template blank first side 202 that will not be etched, and the light blocking portions 214 are disposed on top of the sections that will be etched. The light admitting portions 212 define a shape similar to the desired shape the embellishing wall 30 will form traversing across the template first side 16, as seen in a top view such as that shown in FIG. 9., which in this example, corresponds to the outline of the pinecone. The light blocking portions 214 of the first mask 210 fill the portions of rest of the mask 210 not occupied by the light admitting portions 212. The embellishing wall 30 can be formed to be thicker by using thicker light admitting portions 212, and thinner by using thinner light admitting portions.

Figure 12:
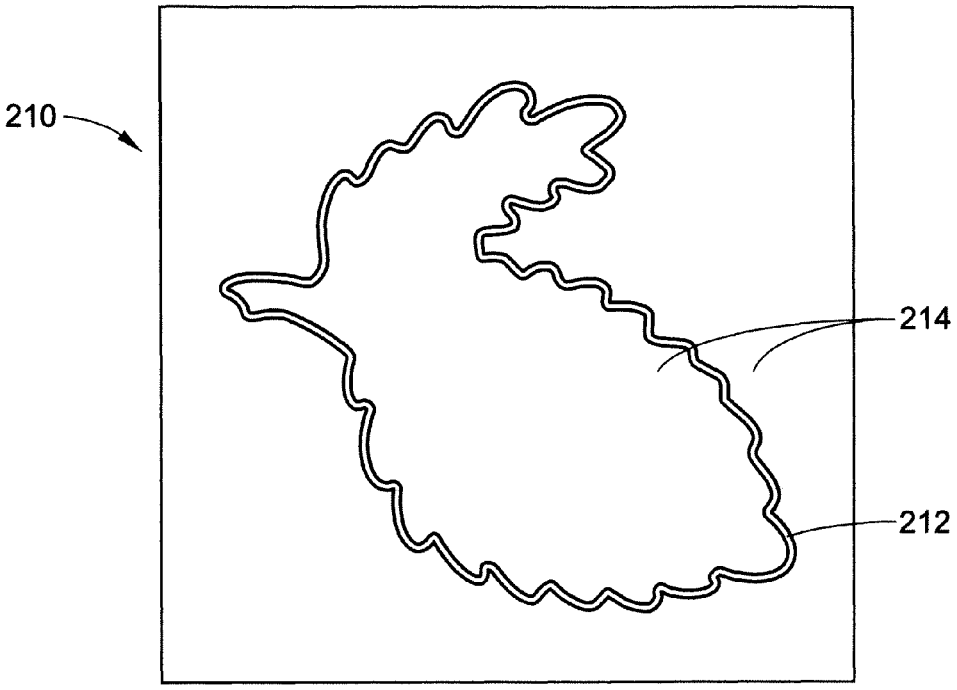
FIG. 12 is a top view of a first mask used in forming the embellishing template in accordance with the invention.
Figure 13:
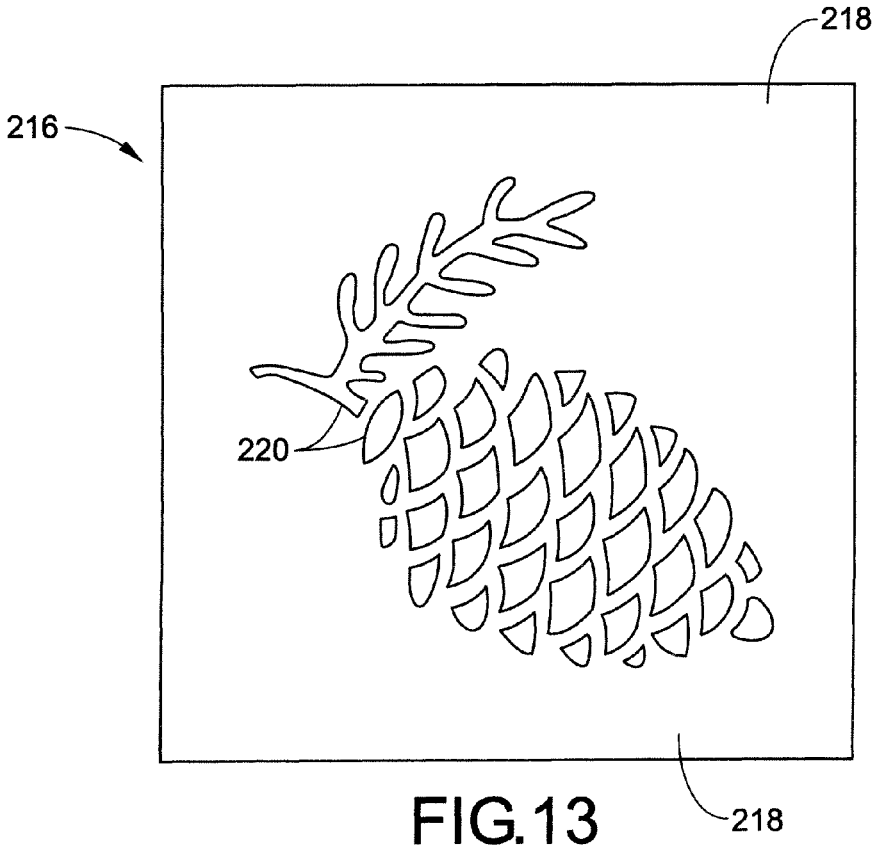
FIG. 13 is a top view of a second mask used in forming the embellishing template in accordance with the invention.

A second mask, shown generally at 216 in FIG. 12, is applied over the resist 208 on the template blank second side 204. The second mask 216 also has light admitting portions 218 and light blocking portions 220 filling the portions of rest of the mask 216 not occupied by the light admitting portions. The light admitting portions 218 are disposed on top of the sections of the template blank second side 204 that will not be etched, and the light blocking portions 218 are disposed on top of sections that will be etched. On the second mask 216, the shape of the light blocking portions 220 correspond to the desired shape of the apertures 24 to be etched into the template blank second side 204 as described below.

Figure 14:
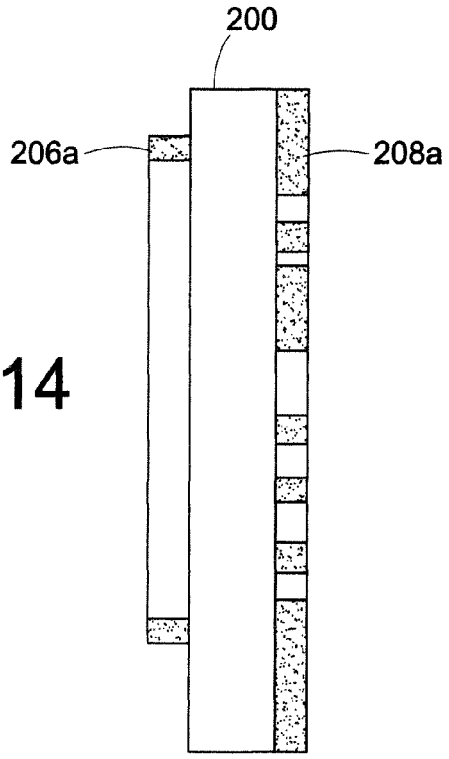
FIG. 14 is a sectional elevational view of a template blank and cured resist used in forming the template in accordance with the invention.

Light, such as for example Ultra-Violet (UV) light, is then directed towards the masks 210 and 216. The light travels through the light admitting portions 212 and 218 striking the photoresist 206 and 208 below them. The portions of the resist receiving the light, shown as 206*a* and 208*a* in FIG. 14, are set, also referred to a cured. Next, the portions of the resist which are not set are washed away, during a step referred to as developing, leaving only the portions 206*a* and 208*a* that are set, as can be seen in FIG. 14.

An etching substance, also referred to as an etchant or chemical etchant, is then applied to the template blank 200 suitable for chemically etching the surface of the template blank for removing the portions of the template blank. In this example, Ferric Chloride 38 baume, from Phibro-Tech, Inc. is used, though other etchants of different strength or types of etchants can be used for etching the template blank. Both sides of the template blank 202, 204 are exposed to the etching substance. The sides 202, 204 can be exposed simultaneously. The etchant etches the first and second sides 202, 204 removing portions of template blank material corresponding to the portions not covered by the resist 206*a*, 208*a*. On the first side 202, the etchant removes portions of the template blank 200, to a depth equal to approximately one half the thickness T, thereby leaving template material forming the embellishing wall 30. On the second side 204, the etchant removes portions of the template blank 200, to a depth equal to approximately one half the thickness of the template blank, to form the apertures 24 extending through the template. The depth of the etching can be defined by controlling the length of time the etchant is allowed to etch the template material and the strength of the etchant.

It has been found that the embellishing wall 30 can be made having a sharper embellishing surface 34 by flash etching the entire first side 14 of the template 10 including the embellishing wall 30. After the first etching step is performed as described above, any remaining resist, such as the resist disposed over the embellishing wall 30 is removed. The entire first side 14 is then flash etched by exposing it to the etchant for a time period of about 1 minute to about 3 minutes. The same etchant used in the first etching step can be used in the flash etching step. In the flash etching step, the etchant etches the corners of the embellishing wall between the wall surface 32 and the embellishing surface 34 to round over, and thus sharpen, the embellishing surface. The embellishing surface 34 can be made more sharp by flash etching for a longer period of time and less sharp by flash etching for a shorter period of time.

The template 10 described herein can be manufactured simply and inexpensively and can provide a wide range of uses. A single template 10 can be used to embellish the media 12 in three different ways including embossing, die cutting and stenciling. The system 100 and method for embellishing media described herein can vary the characteristics of the press forces 120 applied to the media 12 and template 10 to provide pleasing embellishments from a wide variety of different media.

The invention has been described with reference to preferred embodiments. Obviously, modifications and alterations will occur to others upon reading and understanding the preceding specification. It is intended that the invention be construed as including all such modifications and alterations insofar as they come within the scope of the appended claims or the equivalents thereof.

What is claimed is:

1. A method of forming a media embellishing template from a template blank having body with a first side and a second side disposed opposite the first side comprising:

placing resist on a first side of a template blank, the template blank having a thickness T;

placing resist on a second side of the template blank;

exposing the first side to etchant;

exposing the second side to etchant;

etching the surface of the first side not covered by the resist and removing portions of the template blank to a depth of approximately one half of T to form a media abutment surface and an embellishing wall extending from the media abutment surface, the embellishing wall terminating in an embellishing surface; and etching the surface of the second side not covered by the resist and removing portions of the template blank to a depth of approximately one half of T to form at least one embossing aperture extending through the template between the first side and the second side.

2. The method defined in claim 1 wherein the first and second sides are exposed to etchant simultaneously.

3. The method defined in claim 2 further comprising defining the depth of which the portions of the template blank are removed by controlling the length of time etchant is allowed to etch the template blank.

4. The method defined in claim 2 further comprising defining the depth of which the portions of the template blank are removed by controlling the strength of the etchant.

5. The method defined in claim 1 wherein the embellishing wall and embellishing surface form a die blade for die cutting the media.

6. The method defined in claim 1 wherein the step of placing resist on the first side further comprises:

masking the resist on the first side with a mask having light admitting portions and light blocking portions;

curing portions of the resist on the first side with exposure to light through the light admitting portions; and removing portions of the resist from the first side not cured in the curing step.

7. The method defined in claim 1 wherein the step of placing resist on the second side further comprises:

masking the resist on the second side with a mask having light admitting portions and light blocking portions;

curing portions of the resist on the second side with exposure to light through the light admitting portions; and removing portions of the resist from the second side not cured in the curing step.

8. The method defined in claim 1 wherein the thickness T of the template blank is about 0.010 inch to about 0.060 inch thick.

9. The method defined in claim 1 wherein the etching the surface of the first side and the etching the surface of the second side forms the embellishing wall circumscribing the embossing aperture.

10. The method defined in claim 9 wherein the etching the surface of the first side and the etching the surface of the second side forms at least one embossing aperture spaced apart from the embellishing wall.

* * * * *